US007469750B2

(12) United States Patent
Carr

(10) Patent No.: US 7,469,750 B2
(45) Date of Patent: Dec. 30, 2008

(54) EXPANDABLE SEAL

(75) Inventor: Jimmy L. Carr, Fort Worth, TX (US)

(73) Assignee: Owen Oil Tools LP, Houston, TX (US)

( * ) Notice: Subject to any disclaimer, the term of this patent is extended or adjusted under 35 U.S.C. 154(b) by 0 days.

(21) Appl. No.: 11/230,240

(22) Filed: Sep. 19, 2005

(65) Prior Publication Data

US 2006/0065391 A1 Mar. 30, 2006

Related U.S. Application Data

(60) Provisional application No. 60/611,461, filed on Sep. 20, 2004.

(51) Int. Cl.
*E21B 33/128* (2006.01)
*E21B 33/129* (2006.01)

(52) U.S. Cl. ..... 166/387; 166/191; 166/217; 166/138; 277/339; 277/340

(58) Field of Classification Search ..... 166/123, 166/138, 191, 207, 217, 387; 277/336, 339, 277/340

See application file for complete search history.

(56) References Cited

U.S. PATENT DOCUMENTS 3,812,910 A * 5/1974 Wellstein ..... 166/85.2
3,948,321 A 4/1976 Owen et al.
4,901,794 A * 2/1990 Baugh et al. ..... 166/118
5,251,695 A * 10/1993 Coronado ..... 166/242.6
5,293,945 A * 3/1994 Rosenhauch et al. ..... 175/325.2
5,456,327 A * 10/1995 Denton et al. ..... 175/371
6,276,690 B1 8/2001 Gazewood
6,325,389 B1 * 12/2001 Sharify ..... 277/604
6,431,282 B1 * 8/2002 Bosma et al. ..... 166/288
6,834,725 B2 * 12/2004 Whanger et al. ..... 166/384
6,854,522 B2 * 2/2005 Brezinski et al. ..... 166/387
2004/0256808 A1 * 12/2004 Tsuboi et al. ..... 277/377
2005/0173110 A1 * 8/2005 Trahan ..... 166/217
2005/0183610 A1 * 8/2005 Barton et al. ..... 102/275.11
2006/0014269 A1 * 1/2006 Streit et al. ..... 435/287.1

FOREIGN PATENT DOCUMENTS

WO WO 299247 A1 12/2002
WO WO 02099247 A1 * 12/2002

* cited by examiner

*Primary Examiner*—Shane Bomar
(74) *Attorney, Agent, or Firm*—Madan Mossman & Sriram PC

(57) ABSTRACT

In one aspect, the present invention provides a sealing apparatus for use in a tubular member. In one embodiment, the sealing apparatus includes an expandable sleeve and an expandable a toroidal/ring-shaped seal. The seal seats within a circumferential saddle or groove formed in the sleeve. An exemplary seal has an enlarged diameter portion and presents a radially outward sealing surface. During expansion, the enlarged diameter portion is compressed against the tubular member but, at least initially, the remainder of the sealing surface is not compressed. Thus, the pressure associated with the compression is focused on the limited contact area between the seal and the tubular. Continued expansion can increase the contact pressure and/or the amount of contact area. In one arrangement, the seal is configured to provide a gas tight seal.

18 Claims, 3 Drawing Sheets

EXPANDABLE SEAL

CROSS-REFERENCE TO RELATED APPLICATIONS

This application takes priority from provisional U.S. application No. 60/611,461 filed on Sep. 20, 2004.

BACKGROUND OF THE INVENTION

1. Field of the Invention

This invention relates to expandable seals. In one aspect, the present invention relates to sealing systems for use in wellbores.

2. Description of the Related Art

To recover hydrocarbons from the earth, wells are drilled through one or more subterranean hydrocarbon reservoirs. The wells often include a cemented a casing/liner string that strengthen the well (i.e., provide structure integrity) and provide zonal isolation. Typically, the portion of casing adjacent a hydrocarbon reservoir to be drained is perforated so that the hydrocarbons (e.g., oil and gas) can flow into the wellbore.

During the drilling, completion, and production phase, operators find it necessary to perform various remedial work, repair and maintenance to the well, casing string, and production string. For instance, in addition to perforations, holes may be accidentally created in the tubular member. Alternatively, operators may find it beneficial to isolate certain zones. Regardless of the specific application, it is necessary to place certain down hole assemblies such as a liner patch within the tubular member, and in turn, anchor and seal the down hole assemblies within the tubular member.

Referring initially to FIG. 1, there is shown a conventional seal arrangement 10 provided on an end 12 of a tubular member 14 that is to be conveyed and fixed in a wellbore (not shown). The seal arrangement 10 includes metal ribs 16 that act as an anchor and a liquid seal and an elastomer seal 18 that acts as a gas seal. The end 12 is adapted to be expanded diametrically by a swage 20 that is driven axially into the end 12 in a telescopic fashion. In one conventional arrangement, the elastomer seal 18 is positioned approximate to the outer portion of the end 12 and has a rectangular cross section. The radial expansion of the end 12 by the swage 20 expands the seal 18 until it contacts the casing wall (not shown). Further expansion of the seal 18 increases the compressive force applied to the casing wall (not shown) by the seal exterior surface 24. Of note is that the substantially rectangular cross-section of the seal 18 causes all of the exterior sealing surface 24 to contact the casing wall (not shown) at substantially the same time. Therefore, there is a distributed loading of the compression forces applied by the seal 18.

The FIG. 1 embodiment has performed satisfactorily in a variety of applications. Nevertheless, there is a persistent need for wellbore anchoring and/or sealing devices that can meet the ever increasing demands posed by evolving wellbore construction techniques. The present invention is directed to meet these challenges.

SUMMARY OF THE INVENTION

In one aspect, the present invention provides a sealing apparatus for use in a tubular member. In one embodiment, the sealing apparatus includes an expandable sleeve and an expandable a toroidal or ring-shaped seal. The seal seats within a circumferential saddle or groove formed in the sleeve. An exemplary seal has an enlarged diameter portion and presents a radially outward sealing surface. During expansion, the enlarged diameter portion is compressed against the tubular member but, at least initially, the remainder of the sealing surface is not compressed. Thus, the pressure caused by compression is applied to a limited contact area between the seal and the tubular. The resulting pressure profile can include gradients or have asymmetric sections (e.g., a relatively high-pressure at the enlarged diameter portion and lower pressures in the areas adjacent the enlarged diameter portions). In one arrangement, the seal is configured to provide a gas tight seal.

It should be understood that examples of the more important features of the invention have been summarized rather broadly in order that detailed description thereof that follows may be better understood, and in order that the contributions to the art may be appreciated. There are, of course, additional features of the invention that will be described hereinafter and which will form the subject of the claims appended hereto.

BRIEF DESCRIPTION OF THE DRAWINGS or a thorough understanding of the present invention, reference is made to the following detailed description of the preferred embodiments, taken in conjunction with the accompanying drawings, wherein like reference numerals designate like or similar elements throughout the several figures of the drawings and wherein.

DESCRIPTION OF THE PREFERRED EMBODIMENTS

In one aspect, the present invention forms a seal by expanding a resilient sealing member into compressive engagement with an adjacent surface. While the teachings of the present invention will be discussed in the context of oil and gas applications, the teachings of the present invention can be advantageously applied to any number of applications including aerospace, medical devices, chemical processing facilities, automotive applications and other situations where conduits are used to transport or otherwise convey fluids such as liquids and gases. Moreover, while the embodiments of the present invention will be described as a gas tight seal, it should be understood that such embodiments will be also suitable in situations where a liquid seal is desired. Thus, it should be understand that the present invention is not limited to the illustrated examples discussed below.

Figure 2:
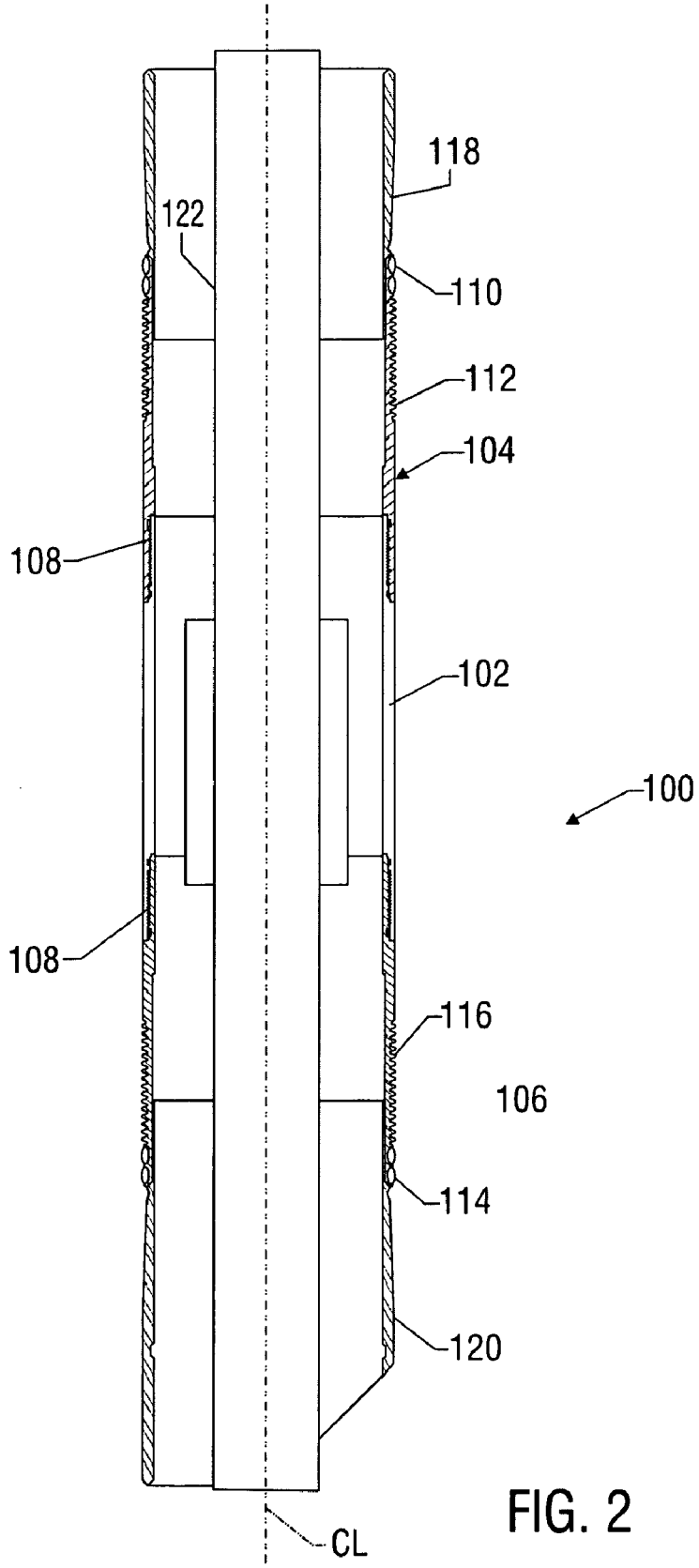
FIG. 2 illustrates a sectional view of one embodiment of a sealing and anchoring system made in accordance with the present invention.

Referring now to FIG. 2, there is shown a wellbore tool 100 that is adapted to suspend a selected wellbore tool in a section of a wellbore. In embodiments, the selected wellbore tool can be a "casing patch" that provides a long-term seal over perforations, splits, corrosion and/or leaks in wellbore tubulars (e.g., casing, liner, production tubing, etc.). Exemplary uses include water shut-off or zonal isolation applications. Additionally, wellbore tools made in accordance with the present invention can be run in any type of well including horizontal, multi-lateral, slim hole, monobore or geothermal and can be tripped into the wellbore via electric/wire line, slick line, tubing, drill pipe or coil tubing. The wellbore tool 100 when deployed patches or seals off a wellbore section having perforations or openings so that the formation fluid does not enter the bore of the wellbore tubular.

In one embodiment, the wellbore tool 100 has a connector or extension section 102, a top expandable anchoring unit 104, a bottom expandable anchoring unit 106, and a joint 108 that connects the connector or extension section 102 to the top and bottom expandable anchoring units 104, 106. The joint 108 can be threaded or use another suitable connection. The anchoring units 104, 106 are constructed as sleeve or mandrel like members having a central bore. In one embodiment, the top-anchoring unit 104 includes a gas tight seal 110 and a combined liquid seal and anchor 112. In like manner, the bottom-anchoring unit 106 has a gas tight seal 114 and a combined liquid seal and anchor 116. A top swage 118 and a bottom swage 120 engage and expand the top and the bottom anchoring units 104 and 106. During installation, the top swage 118 is driven axially inside the top expandable anchoring unit 104. Because the top swage 118 has an exterior diameter that is larger than an interior bore diameter of the top expandable anchoring unit 104, the top expanding anchoring unit 104 is expanded radially outwards and into engagement with an interior surface of a wellbore tubular such as casing, liner, tubing, etc (not shown). For convenience, the wellbore tubular will be referred to as casing. In like manner, the bottom swage 120 is driven axially inside the bottom expandable anchoring unit 106 to expand the bottom anchor unit 106 into engagement with the casing interior (not shown). As used herein, the axis CL of the tool 100 should be understood as the point of reference for the radial or diametrical expansions described.

A setting tool 122 is used to axially displace the bottom and top swages 118, 120. Suitable setting tools are discussed in U.S. Pat. No. 6,276,690 titled "Ribbed sealing element and method of use" and U.S. Pat. No. 3,948,321 titled "Liner and reinforcing swage for conduit in a wellbore and method and apparatus for setting same", both of which are incorporated by reference for all purposes. The setting tool can be hydraulically actuated or use pyrotechnics or some other suitable means.

The top and bottom fluid seal anchors 112, 116 include continuous circumferential metal ribs that form a metal-to-metal seal with the adjacent casing when expanded. The metal-to-metal contact provides a liquid seal that prevents the flow of liquids between the casing and the anchoring units 104, 106 and an anchoring mechanism that suspends the wellbore tool 100 within the casing. The engagement between the top and bottom fluid seal anchors 112, 116 can utilize a number of variations in the engagement between the casing wall (not shown) and the ribs. For example, the ribs can be made harder than the casing wall so that the ribs penetrate or "bite" into the casing to enhance anchoring. Also, the ribs can be formed softer than the casing wall such that the ribs flow into the discontinuities in the casing wall to enhance sealing. In still other arrangements, a combination of relatively hard and relatively soft ribs can be used to provide multiple types of engagement between the ribs and the casing wall.

The seals 110, 114 form a barrier that prevents the flow of gases between the top and bottom-anchoring units 104, 106 and the casing wall. In one embodiment, the seals have a generally toroidal shape and are formed at least partially from a resilient material. By resilient, it is meant that the material can be deformed (e.g., radially expanded) without a detrimental degradation of a material property relevant to its function as a seal. The material used for the seal can be an elastomer or other natural or man-made material. The particular material may be selected in reference to the wellbore chemistry and type of fluids or gases present in the wellbore environment. For example, materials such as hydrosulfide, natural gas, materials for acid washing each may pose a different concern for the seal material. Therefore, some materials may be suited for certain applications while other materials are suited for different applications. Additionally, the seals may be hybrid (made of two or more materials), can include inserts, and/or include one or more surface coatings.

Figure 1:
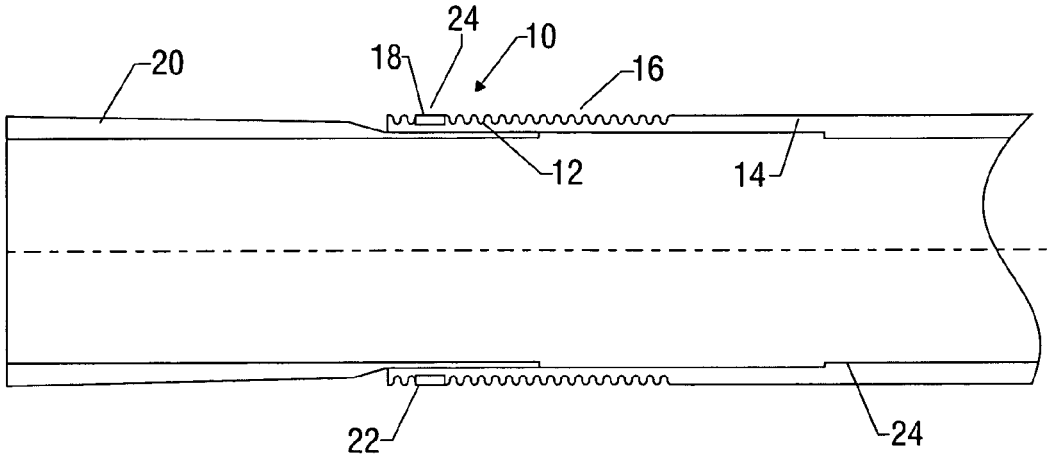
FIG. 1 (Prior Art)
FIG. 1 illustrates a sectional view of a prior art sealing and anchoring system.
Figure 5:
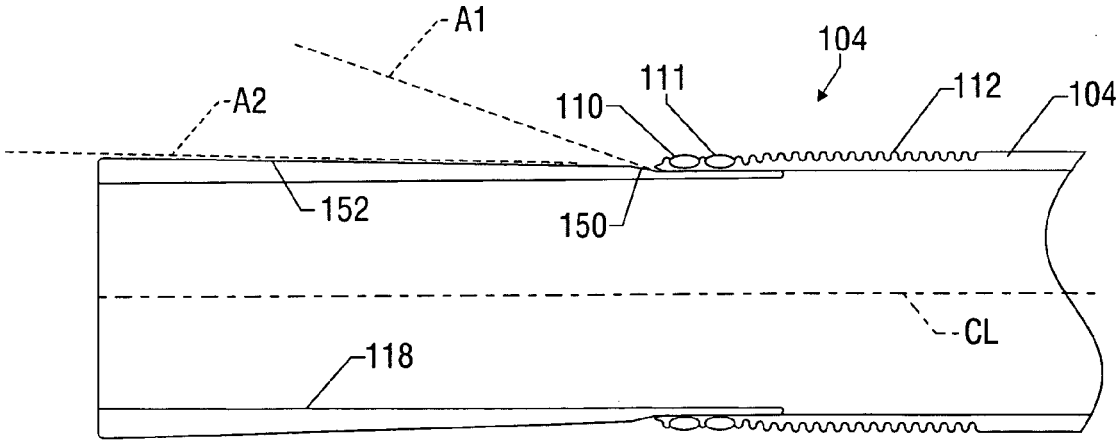
FIG. 5 illustrates a sectional view of another sealing and anchoring arrangement made in accordance with one embodiment the present invention.
Figure 3:
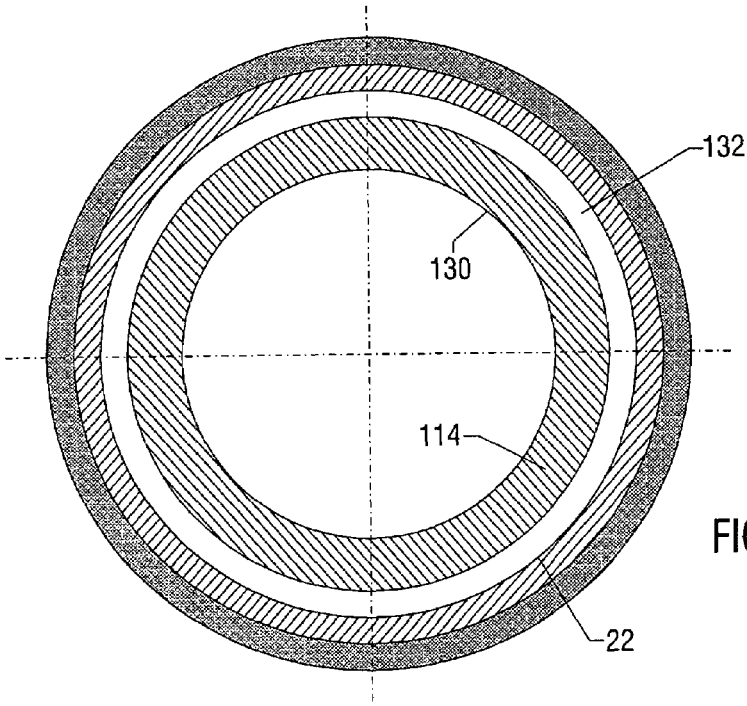
FIG. 3 illustrates a cross-sectional view of a sealing member made in accordance with one embodiment of the present invention.
Figure 4:
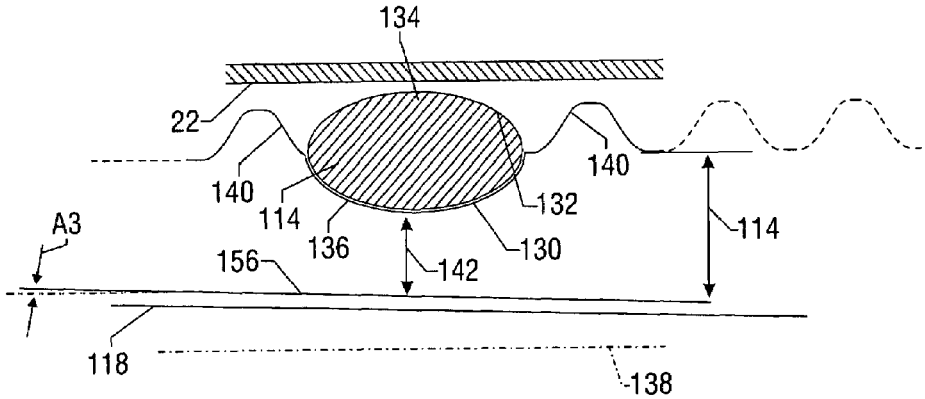
FIG. 4 illustrates a sectional view of a sealing and anchoring arrangement made in accordance with one embodiment the present invention.

FIGS. 3-5 illustrate one embodiment of a gas tight seal that is in accordance with the teachings of the present invention. For simplicity, the gas tight seal will be discussed with reference to seal 110 with the understanding that the discussion is equally applicable to the gas tight seal 114. The gas tight seal 110 includes a radially inward seating surface 130 and a radially outward sealing surface 132. As shown in FIG. 4, the seal 110 has an arcuate shaped sealing surface 132 that provides an enlarged diametrical portion 134. When the sealing member 110 is expanded radially outward, the enlarged diametrical portion 134 provides an initial contact surface area with the casing wall 22. Further expansion of the seal 110 incrementally increases the surface area that contacts the casing surface 22 due to the deformation of the seal 110. Conventional seals have rectangular cross-sections (FIG. 1) that apply a distributed compressive loading because there is little if any change in the surface area in contact with the casing surface during expansion. The present invention provides, in one embodiment, a seal that initially has a localized or concentrated compressive loading and upon expansion, increases the contact surface upon which a compressive loading is applied. It should be appreciated that by limiting the initial contact area, a relatively greater compressive pressure is applied to the casing wall for a given expansion force.

While an elliptical shape is shown for the seal 114, other shapes that provide a non-distributed initial loading may also prove satisfactory. For example, an ovoid shape or other cross-sectional form having an arcuate shape but non-centralized enlarged diameter portion can also be suitable. Moreover, planar as well as arcuate surfaces may also be useful provided that they induce, at least initially, a localized contact surface. For example, a rhomboid or triangular profile may also be suitable in certain applications because less than all or substantial portion of the available seating surface comes initially into contact with the casing wall. Thus, generally, a suitable cross-sectional profile includes a profile that enables a seal to engage a casing surface with a compressive force that is not initially evenly distributed along all or substantially all of the available sealing surface of a seal. Stated differently, a suitable cross-sectional profile can include a profile that focuses or concentrates the compressive force applied by the sealing surface to the casing wall at least initially during expansion. The pressure profile associated with such a cross sectional profile can include regions having pressure gradients (i.e., an increase or decrease in pressure across a given region) and/or asymmetric pressure regions (e.g., some regions having pressure different from other regions). Exemplary pressure profiles include a relatively central high-pressure region flanked by two or more similar low-pressure regions, an offset high-pressure region flanked by two or more low-pressure regions, a series of regions having successfully higher pressures, high-pressure regions separated by a low-pressure valley, etc. In embodiments, as the contact surface between the seal and the casing wall increases, the magnitude of the contact pressure can remain substantially constant or vary (i.e., increase or decrease).

The seal 114 is seated within a circumferential saddle 136 that is formed in an end 138 of the top anchoring unit 104. The seal seating surface 130 and the saddle 136 are in one embodiment formed with an elliptical or other arcuate shape that enables controlled application of the compressive forces generated by the expansion of the expandable anchoring unit 104 (FIG. 2). The shape of the seating surface 130 can be the same as or different from the shape of the sealing surface 132. For example, the seating surface 130 may be circular and the sealing surface 132 may be elliptical, the seating surface 130 may be rectangular and the sealing surface 132 may be circular, the seating surface 130 may be elliptical and the sealing surface 132 may be rhomboid, etc. In any case, the complementary or matching profiles of the saddle 136 and the seating surface 130 enhance the operation of the seal 114 by providing an even or controlled compression of the material making up the seal 114. It should be understood that a seal is formed between the seating surface 130 and the saddle 136.

Referring back to FIG. 4, the seal 114 may be utilized in an arrangement that includes one or more features that control the sealing action. In one arrangement, one or more raised elements 140 may be formed adjacent the seal 114. The size, shape and location of the raised elements 140 may be selected based on the particular function that the raised elements 140 perform. In the one arrangement, the raised elements 140 are formed diametrically large enough to protect the seal 114 from contact with inside surfaces of the wellbore and wellbore structures while the wellbore tool 100 is tripped into the wellbore. Thus, in such an embodiment, the raised elements 140 have a height or radial distance sufficient to protect wellbore structures and objects from scratching or otherwise damaging the seal 114. Such raised elements 140 be structurally similar to the metal ribs 112. Indeed, the metals seals 112 may provide sufficient height to provide protection to the seal 114 during tripping into the well. Additionally, one or more raised elements 140 can be formed to protect or minimize the risks that wellbore fluids flowing over the seal 114 flows between the seal 114 and the saddle 130. That is, the raised elements 140 can prevent the hydrodynamic flushing of the seal 114. Additionally, one or more raised elements 114 can be provided to act as a stop that protects the seal 114 from over pressurization or over compression. For example, in one arrangement, the seal 114 is configured to deform from a relaxed state to a specified operating dimension; e.g., to compress from a nominal outer diameter to a specified smaller operating diameter. This specified operating dimension is maintained by appropriate selection of the height of one or more of the raised elements 140. Also, the raised elements 140 can act as a liquid seal to limit the amount of wellbore fluids that come into contact with the seal 114. In a manner previously described, the raised elements 140 can have a controlled hardness that allows a penetration and/or embedding into the casing wall. Thus, in embodiments, a plurality of raised elements 140 can be provided, each of which performs a different task. In other embodiments, a raised element 140 can perform multiple tasks.

In one embodiment, the seal 114 is recessed from the outer diameter the ribs 112 as shown in FIG. 5 (or other element such as the raised element 140). By recessing the seal 114, wellbore structures have a less likely chance of cutting or scraping the sealing surface 132. At noted earlier, the swage 118 is used to radially expand the end 104. It is during this expansion that the seal 114 begins to protrude beyond the ribs 112. Thus, the seal 114 has a first position where it is below the ribs 112 and a second sealing position where it is exposed and protrudes at least temporarily radially beyond the outer dimensions of the ribs 112. While the seal 114 is shown as flanked by two raised elements 140, a single raised element 140 or three or more raised elements 140 may be suitable for other applications.

Referring now to FIGS. 4 and 5, the gas tight seal 110 is used in conjunction with a liquid seal that is formed by the circumferential metal ribs 112. In one embodiment, the swage 118 and end 110 are configured to control the response of the metal ribs 112 and the resilient gas tight seal 110 to the expansion force produced as the swage 118 enters the end 110. For example, the thickness of the material radially inward of the seal 110 and the metal ribs 112 can be varied to control the magnitude of the expansion force applied to each of these elements. For example, by making the material below the seal 110 (defined by numeral 142) thinner than material below the ribs 112 (defined by numeral 144), the swage 118 can radially expand the anchoring unit 104 portion adjacent the seal 110 more easily than the joint portion adjacent the ribs 112 because less material resists the expansion force. Also, the force vectors accompanying the radial expansion caused by the swage 118 can be controlled by providing inclined surfaces on the swage 118 and the interior surface 156 of the end 138. For example, the swage 118, which is a generally tubular member, can have first and second inclined surfaces 150, 152, each of which has a different angle A1, A2. For instance, the first angle A1 can be between 10 to 20 degrees and a second angle A2 can be between 1 to 2 degrees. Thus, the swage 118 expands the anchoring unit 104 in a two-step process where there is a first relatively large expansion caused by the first inclined surface 150 that is followed by a more graduated expansion by the second inclined surface 152. Additionally, the interior surface 156 adjacent the seal 110 can include an incline complementary to the incline(s) of the swage 118. For example, the interior surface 156 can have an angle A3 that is approximately the same as the angle A2 of the second inclined surface 152. It will be appreciated that such matched or complementary angles will result in a radial expansion that is substantially orthogonal to the axial centerline CL of the wellbore tool 100. Additionally, in certain embodiments, a second seal 111 may be positioned adjacent the seal 110. In such an arrangement, the substantially orthogonal expansion can enable both seals 110, 111 to move radially outward substantially simultaneously.

The present invention can be used in any instance where it is desired to have a gas tight seal. As noted previously, the aspects of the present invention can be used in tools that patch or otherwise seal off a section of the wellbore. However in other embodiments of the present invention, the seals can be used to provide a casing suspension system. For example an anchoring tool may be provided with a set of metal seals and a set of gas tight seals. The seals when combined will provide a gas and liquid tight pipe and anchoring tool from which other tools can be suspended from below or stacked above.

In one mode of operation, a tool made up of a section having an upper and lower anchoring unit are made up and disposed in the wellbore. The unit may be conveyed into the wellbore in conjunction with a setting tool. Once the wellbore tool has been set in the desired location in the wellbore, the setting tool is actuated. In one arrangement, actuating the setting tool causes upper and lower swages to be driven inward into the wellbore unit. The entry of the swages into the upper and lower anchoring unit forces out or expands the ribs and seals of the upper and lower anchoring units. In one configuration, the gas tight seal first expands into contact with the casing interior and thereafter the metal ribs expand to engage the casing. In other arrangements the gas tight seal and the metal seals come into contact at essentially the same time. In still other embodiments, the swage includes inclines that expand the seals and ribs using two different inclines.

As noted previously, sealing arrangements made in accordance with the present invention can be used to for water shut-off/zonal isolation and casing/tubing repair applications. Other tooling that can make advantageous use of the teachings of the present invention include velocity strings, sump packers, hanger systems for gravel packing, screen suspension systems, and large internal diameter polished bore receptacles. These devices can be positioned on the extension section 102 in lieu of the extension section 102 (FIG. 3). It should be appreciated that above embodiments are merely exemplary of the numerous adaptations and variations available under the teachings of the present invention. For example, in certain embodiments, slips may be used to anchor the wellbore tool within a wellbore. The slips can either cooperate with the expandable ribs (e.g., act as either a primary or back-up anchoring system) or exclusively anchor the wellbore tool. Additionally, the liquid seals and the gas seals need not be on the same joint or sleeve. Rather a first joint can include the gas seal and a second joint can include the liquid seal. In other variations, embodiments of seals made in accordance with the present invention can be formed as seals that provide a controlled leakage of gas and liquids rather than providing minimal or no leakage. In other variations, the teachings of the present invention can be used to provide internal seals in wellbore drilling motors, bottomhole assembly steering units, drill strings, casing strings, liner strings, and other tools and equipment used in wellbore applications.

Those of skill in the art will recognize that numerous modifications and changes may be made to the exemplary designs and embodiments described herein and that the invention is limited only by the claims that follow and any equivalents thereof.

What is claimed is:

1. A sealing apparatus for use in a wellbore tubular, comprising:

(a) radially expandable sleeve member having a groove having an arcuate portion;

(b) a radially expandable seal member disposed in the groove, the seal member having a radially outward sealing surface that increases surface contact area with the wellbore tubular as the seal member expands, wherein the seal member has a seating surface complementary to the arcuate portion; and (c) at least one expandable anchor element that includes a plurality of circumferential ribs, wherein expanding the expandable sleeve member compresses the radially expandable seal member against the wellbore tubular to form a substantially gas tight seal and expands the at least one expandable anchor element into anchoring engagement with the wellbore tubular to form a substantially liquid tight seal, the substantially liquid tight seal being formed of the plurality of ribs.

2. The sealing apparatus according to claim 1 wherein the seal member has a substantially elliptical cross-sectional profile and wherein the arcuate portion is configured to apply a substantially even compression to the seating surface when the radially expandable sleeve member is expanded.

3. The sealing apparatus according to claim 1 wherein the radially expandable sleeve member has an outer surface, wherein the groove is formed on the outer surface and further comprising at least one raised element formed on the outer surface and proximate to the seal member, the at least one raised element being configured to prevent a hydrodynamic flushing of the seal member.

4. The sealing apparatus according to claim 1 wherein the radially expandable sleeve member has an outer surface, wherein the groove is formed on the outer surface and further comprising at least one raised element formed on the outer surface and wherein the at least one raised element being configured to control the maximum compression of the seal member by allowing the seal member to compress from a relaxed state to a specified operating dimension.

5. The sealing apparatus according to claim 3 wherein the seal member is at least initially radially recessed relative to a circumferential rib formed adjacent the at least one raised element.

6. The sealing apparatus according to claim 1 further comprising a swage configured to expand the sleeve member.

7. The sealing apparatus according to claim 6 wherein the swage telescopically engages the sleeve member and includes at least one inclined surface adapted to slide against an inner surface of the sleeve member, the sliding action causing the sleeve member to expand.

8. The sealing apparatus according to claim 7 wherein the sleeve member inner surface has at least one inclined surface complementary to the at least one inclined surface of the swage.

9. The sealing apparatus according to claim 1 wherein the plurality of circumferential ribs are formed at an axially spaced-apart distance from the seal member.

10. The sealing apparatus according to claim 9 wherein the circumferential ribs are formed of a material harder than the wellbore tubular.

11. The sealing apparatus according to claim 9 wherein the sleeve member and a swage coact to provide an expansion force for the seal member that is different from the expansion force provided for the circumferential ribs.

12. The sealing apparatus according to claim 11 wherein the different expansion forces are caused by different sleeve member thicknesses at the seal member and the circumferential ribs.

13. The sealing apparatus according to claim 1 further comprising a plurality of seal members disposed on the sleeve member.

14. A sealing apparatus for use in a wellbore tubular, comprising:

(a) a first anchoring member having (i) a sleeve member having an outer surface in which a circumferential saddle having an arcuate portion is formed, the sleeve member being radially expandable, (ii) a radially expandable ring member disposed in the saddle and having an enlarged diameter portion, the ring member being configured to be compressed against the tubular member to form a gas tight seal, and (iii) at least one expandable anchor element configured to form a liquid tight seal, wherein expanding the sleeve member compresses the ring member against the wellbore tubular to form a substantially gas tight seal and expands the at least one expandable anchor element into anchoring engagement with the wellbore tubular to form a substantially liquid tight seal, wherein the first anchoring member is further configured to form the substantially liquid tight seal after forming the substantially gas tight seal;

(b) a second anchoring member having (i) a sleeve member having an outer surface in which a circumferential saddle having an arcuate portion is formed, the sleeve member being radially expandable, and (ii) a radially expandable ring member disposed in the saddle and having an enlarged diameter portion, the ring member being configured to be compressed against the tubular member to form a gas tight, and (iii) at least one expandable anchor element configured to form a liquid tight seal, wherein expanding the sleeve member compresses the ring member against the wellbore tubular to form a substantially gas tight seal and expands the at least one expandable anchor element into anchoring engagement with the wellbore tubular, wherein the second anchoring member is further configured to form the substantially liquid tight seal after forming the substantially gas tight seal; and (c) an extension having a first ended matable with the first anchoring member and a second end matable with the second anchoring member.

15. The sealing apparatus according to claim 14 wherein the first and second anchoring members and the extension cooperate to minimize the flow of a formation fluid into the wellbore tubular.

16. The sealing apparatus according to claim 14 wherein each of the at least one anchor elements further comprise a plurality of circumferential ribs that anchor the sealing apparatus in the wellbore tubular when expanded.

17. The sealing apparatus according to claim 14 wherein the extension includes one of (i) a gravel pack, (ii) a sand screen, (iii) a liner.

18. A method for using a sealing apparatus in a wellbore tubular, comprising:

(a) forming a groove in a radially expandable sleeve member that has an arcuate portion;

(b) disposing a radially expandable seal member in the groove, the seal member having a radially outward sealing surface that increases surface contact area with the wellbore tubular as the seal member expands, wherein the seal member has a seating surface complementary to the arcuate portion;

(c) disposing at least one expandable anchor element adjacent to the radially expandable seal member;

(d) expanding the expandable sleeve member to compress the radially expandable seal member against the wellbore tubular to form a substantially gas tight seal; and (e) expanding the at least one expandable anchor element into anchoring engagement with the wellbore tubular to form a substantially liquid tight seal after expanding the seal member.

* * * * *

UNITED STATES PATENT AND TRADEMARK OFFICE

CERTIFICATE OF CORRECTION

PATENT NO. : 7,469,750 B2
APPLICATION NO. : 11/230240
DATED : December 30, 2008
INVENTOR(S) : Jimmy L. Carr It is certified that error appears in the above-identified patent and that said Letters Patent is hereby corrected as shown below:

Column 2, line 21, delete “or a thorough”, insert --For a thorough--;

Column 8, line 5, delete “being”, insert --is--;

Column 8, line 67, delete “gas tight”, insert --gas tight seal--; and

Column 9, line 10, delete “ended”, insert --end--.

Signed and Sealed this

Twenty-fourth Day of February, 2009

JOHN DOLL
*Acting Director of the United States Patent and Trademark Office*